US008307902B2

(12) United States Patent
Telfer

(10) Patent No.: US 8,307,902 B2
(45) Date of Patent: Nov. 13, 2012

(54) DOWNHOLE FLOW CONTROL TOOL AND METHOD

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 309 days.

(21) Appl. No.: 12/601,762

(22) PCT Filed: May 21, 2008

(86) PCT No.: PCT/GB2008/001736

§ 371 (c)(1),
(2), (4) Date: Jun. 8, 2010

(87) PCT Pub. No.: WO2008/142409

PCT Pub. Date: Nov. 27, 2008

(65) Prior Publication Data

US 2010/0252281 A1 Oct. 7, 2010

(30) Foreign Application Priority Data

May 24, 2007 (GB) ..... 0709953.4

(51) Int. Cl.
*E21B 34/00* (2006.01)

(52) U.S. Cl. ..... 166/334.4; 166/115; 166/331; 166/319; 166/321; 137/98; 137/884; 137/625.34; 137/625.27; 137/625.64

(58) Field of Classification Search ..... 166/115, 166/331, 334.4, 319, 321; 137/98, 884, 625.27, 137/625.34, 625.64, 625.65
See application file for complete search history.

(56) References Cited

U.S. PATENT DOCUMENTS

| | | | | |
|---|---|---|---|---|
| 5,392,862 | A * | 2/1995 | Swearingen | 166/386 |
| 5,564,500 | A * | 10/1996 | Rogers et al. | 166/312 |
| 6,253,861 | B1 * | 7/2001 | Carmichael et al. | 175/237 |
| 6,371,208 | B1 * | 4/2002 | Norman et al. | 166/334.4 |
| 2009/0056952 | A1 | 3/2009 | Churchill | |

FOREIGN PATENT DOCUMENTS

| | | | |
|---|---|---|---|
| WO | 01/04457 | A1 | 1/2001 |
| WO | 2004/088091 | A1 | 10/2004 |
| WO | 2007/060449 | A3 | 5/2007 |

OTHER PUBLICATIONS

International Search Report for PCT/GB2008/001736 mailed Sep. 30, 2008 (3 pages).
Written Opinion of ISA for PCT/GB2008/001736 mailed Sep. 30, 2008 (5 pages).

* cited by examiner

*Primary Examiner* — Giovanna Wright
*Assistant Examiner* — Ronald Runyan
(74) *Attorney, Agent, or Firm* — Osha Liang LLP

(57) ABSTRACT

A downhole flow control tool 1, includes a flow control member in the form of a sleeve 8, and comprises a main body 2 having a longitudinal internal bore 3 extending therethrough, an upper end 4 having a box section 6, and a lower end 5 with a pin section 7, which enable connection of the tool 1 into a work string. The flow control sleeve 8 is mounted for movement relative to the bore 3 between at least a closed and one of several open positions. The tool body 2 includes several flow ports extending through a wall of the body 2 and spaced around a circumference of the body 2. The tool provides multiple fluid flow control options for directing and splitting fluid flow for example during a drilling operation to clear settled cuttings by suitable location of the tool.

34 Claims, 4 Drawing Sheets

DOWNHOLE FLOW CONTROL TOOL AND METHOD

TECHNICAL FIELD OF THE INVENTION

The present invention relates to a downhole flow control tool and to a method of controlling fluid flow downhole. In particular, but not exclusively, the present invention relates to a downhole flow control tool for controlling the flow of fluid to an exterior of the tool through a flow port in a wall of a main body of the tool, and to a corresponding method.

BACKGROUND OF THE INVENTION

In the oil and gas exploration and production industry, a wellbore is drilled from surface to gain access to subterranean hydrocarbon deposits. A wellbore or borehole of an oil or gas well is typically drilled from surface to a first depth and lined with a steel casing which is cemented in place. The borehole is then extended and a further section of smaller diameter casing is located in the extended section and also cemented in place. This process is repeated until the wellbore has been extended to a certain depth, and tubing known as a liner is then typically located in the borehole, extending from the deepest casing section (the casing 'shoe') to a producing formation. The well is then completed by locating a string of production tubing within the casing/liner and perforating the liner such that well fluids may flow from a producing formation, into the liner, and through the production tubing to surface.

During the drilling procedure, fluid is circulated from surface down a drill string extending into the wellbore being drilled, exiting through ports in a drillbit provided lowermost on the string. This fluid flows up along an annulus defined between a wall of the wellbore and an external surface of the drill string, carrying drill cuttings and other solids back to surface. The drilling fluid also functions to cool the drillbit during drilling, and to balance hydrostatic formation pressures.

Frequently, solids carried back to surface in the drilling fluid fall out of suspension and accumulate in the wellbore. This is a particular problem in highly deviated wells. As a result, it is necessary to pump drilling fluid downhole at high pressures, in order to maintain a high velocity flow along the annulus to surface, with the solid material entrained in the fluid. This is both expensive, in terms of pressurising the drilling fluid to the required levels using suitable pumps, and has an adverse effect upon downhole components such as drilling motors and drill bits, reducing their operational lives. Accordingly, it is not always possible to pump drilling fluid downhole at levels which are sufficiently high to maintain flow of cuttings and other solids to surface along the wellbore annulus.

When drill cuttings and other solids build up in a wellbore, it is necessary to carry out remedial action to ensure that the drill string does not become stuck. To this end, it is known to incorporate a circulation tool into a drill string, for selectively circulating fluid into the wellbore annulus at a point along a length of the drill string, to clean an internal surface of wellbore tubing at a desired location. One such circulation tool is disclosed in the Applicant's International Patent Publication No. WO2004/088091, which can be selectively activated to open a flow path to annulus through a wall of a body of the tool.

Whilst the tool disclosed in WO2004/088091 is effective in providing selective fluid circulation to annulus, it is desired to improve upon the methods and apparatus disclosed therein.

It is amongst the objects of embodiments of the present invention to obviate or mitigate at least one of the foregoing disadvantages.

SUMMARY OF THE INVENTION

According to a first aspect of the present invention, there is provided a downhole flow control tool comprising:

a main body having an internal bore for the passage of fluid therethrough;

at least one first fluid flow port extending through a wall of the main body for the selective flow of fluid from the body internal bore to an exterior of the tool, the at least one first fluid flow port comprising an outlet having a first fluid flow area;

at least one second fluid flow port extending through the main body wall for the selective flow of fluid from the body internal bore to the tool exterior, the at least one second fluid flow port comprising an outlet having a second fluid flow area greater than said first fluid flow area; and a flow control member mounted for movement relative to the body main bore between: a closed position in which both the at least one first and the at least one second fluid flow ports are closed, to thereby prevent flow of fluid from the body main bore to the tool exterior through said ports; a first open position in which fluid flow from the body main bore to the tool exterior through one of the at least one first and the at least one second fluid flow ports is permitted; and a second open position in which fluid flow from the body main bore to the tool exterior through the other one of the at least one first and the at least one second fluid flow ports is permitted.

Providing a flow control tool having such first and second flow control ports permits selective jetting of fluid to the exterior of the tool at different velocities. This is because the velocity of fluid exiting the at least one first fluid flow port will be higher than the velocity of fluid exiting the at least one second fluid flow port (for fluid in the main body bore of a given fluid pressure), due to the differences in flow areas of the port outlets. Jetting fluid at such a higher velocity assists in transporting solids such as drill cuttings to surface along an annulus defined between a wellbore wall and an external surface of a tubing string in which the tool is coupled. Such jetting also assists in scouring solid debris from the wellbore wall.

Furthermore, providing the at least one first flow port with outlets having a first flow area which is smaller than the second flow area of the second flow port results in a higher backpressure in the fluid in the main bore when the at least one first flow port is open, compared to the at least one second fluid flow port. Thus, when the at least one first fluid flow port is open, a substantial part of the fluid entering the tool still flows on down through the body main bore and out of the tool at a downstream end of the bore. In contrast, when the at least one second fluid flow port is open, the backpressure is lower, such that a larger part of the fluid entering the tool is encouraged to flow through the at least one second flow port to the tool exterior. A significantly smaller volume of the fluid entering the tool then flows on down through the tool internal bore. This provides a boosting function, to direct a majority of the flow to the tool exterior and thus to the annulus. This is of particular utility in deviated wells, where there is a tendency for solids to accumulate on the low side of the deviated bore, blocking the annulus. Directing a boosted flow to the tool exterior helps to clear such blockages.

Preferably, the at least one first fluid flow port is inclined relative to the tool main body, and may be inclined relative to an axis of the body internal bore. Said first flow port may be inclined such that, in use, fluid exiting the flow port outlet is directed or jetted in an uphole direction, to thereby stimulate fluid flow to surface. The at least one first fluid flow port may be arranged such that an axis of the port intersects with said body bore axis. Alternatively, the at least one first fluid flow port may be arranged such that the port axis does not intersect with said body bore axis, to stimulate a helical flow of fluid in a wellbore in which the tool is located.

In the first open position of the flow control member, the at least one second flow port may be closed and flow directed through the at least one first flow port. Additionally, in the second open position of the flow control member, the at least one first flow port may be closed and flow directed through the at least one second flow port.

The at least one first and at least one second fluid flow ports may be spaced relative to one another, and in a preferred embodiment are axially spaced along the body main bore. The flow control member may be movable axially relative to the body main bore for controlling flow of fluid through the selected one of the at least one first and at least one second fluid flow ports. The at least one first and at least one second fluid flow ports may additionally or alternatively be spaced circumferentially relative to one another. The flow control member may then be correspondingly rotationally movable relative to the body bore, for controlling flow through the selected one of the at least one first and at least one second fluid flow ports.

The tool may comprise at least one third fluid flow port extending through a wall of the main body for the selective flow of fluid from the body internal bore to an exterior of the tool, the at least one third fluid flow port comprising an outlet having a third fluid flow area which may be greater than said second flow area, or smaller than said first flow area. The flow control member may then be movable to a third open position in which fluid flow form the main body bore to the tool exterior through the at least one third fluid flow port is permitted. The at least one third flow port may be axially and/or circumferentially spaced along the body main bore relative to both the at least one first and at least one second flow ports.

Preferably, the tool comprises a plurality of first fluid flow ports and a plurality of second fluid flow ports, the first and second fluid flow ports arranged around a circumference of the main body.

The flow control member may be repeatedly movable and thus adapted to be cycled between the closed position, the first open position and the second open position. This may permit repeated selective control of fluid flow either entirely down through the body main bore; partial flow through the at least one first flow port; or partial flow through the at least one second flow port.

The flow control member may comprise an indexing sleeve having an indexing channel adapted to cooperate with an indexing pin coupled to the main body, for controlling movement of the flow control member, and thus location of the flow control member in a selected one of the closed, the first open and the second open positions. The flow control member may comprise a flow control sleeve mounted for movement within the body bore, the flow control sleeve comprising an at least one sleeve port for selectively permitting fluid communication between the body internal bore and a selected one of the at least one first and at least one second fluid flow ports, depending upon whether the flow control member is in the closed, first open or second open position. The at least one sleeve port may define a flow area which is at least equal to the second flow area of the second body fluid flow port.

The indexing sleeve may be mounted on the flow control sleeve for controlling movement thereof. The indexing sleeve may comprise an indexing channel extending around a circumference thereof, which channel may comprise a first detent position corresponding to the closed position of the flow control member; a second detent position corresponding to the first open position of the flow control member; and a third detent position corresponding to the second open position of the flow control member. Where the tool comprises at least one third fluid flow port, the indexing channel may comprise a fourth detent position corresponding to the third position of the flow control member. The indexing channel may also comprise a plurality of intermediate detent positions, one between the closed and the first detent position; one between the first and the second detent positions; and one between the second and the closed detent position. The closed, first and second detent positions are preferably axially and circumferentially spaced around the indexing sleeve relative to one another. The intermediate positions may each be at a common axial position on the indexing sleeve, and may be axially spaced relative to each of the closed, first and second detent positions. Each intermediate detent position may also be circumferentially spaced relative to an adjacent intermediate detent position.

Preferably, the flow control member is movable under applied fluid pressure, and may comprise a seat for receiving an actuating element such as a ball, for moving the flow control member between the closed, first open and second open positions. The flow control member may be biased in an uphole direction such that when an actuating element is landed on the seat, a fluid pressure force acting on the actuating element is transmitted to the seat and thus to the flow control member, to act against the biasing force, to thereby move the flow control member.

According to a second aspect of the present invention, there is provided a method of controlling fluid flow downhole, the method comprising the steps of:

locating a flow control tool downhole;

directing fluid into an internal bore of a main body of the tool, the main body having at least one first fluid flow port extending through a wall of the main body and comprising an outlet having a first fluid flow area and at least one second fluid flow port extending through the main body wall and comprising an outlet having a second fluid flow area greater than said first fluid flow area;

locating a flow control member of the tool in a closed position where the at least one first and the at least one second fluid flow ports are closed, so that the fluid entering the tool flows through the body internal bore and exits the tool;

selectively moving the flow control member relative to the internal bore to a first open position in which at least part of the fluid entering the tool flows through one of the at least one first and the at least one second fluid flow ports and thus to an exterior of the tool; and selectively moving the flow control member to a second open position in which at least part of the fluid entering the tool flows along the other one of the at least one first and the at least one second fluid flow ports and thus to the exterior of the tool.

The method may be a method of controlling fluid flow downhole during a wellbore drilling operation, and may further be a method of selectively directing fluid into an annulus defined between a wellbore wall and the exterior of a tubing string carrying the tool, optionally to stimulate flow of fluid to surface. Drilling may initially proceed with the flow control member in a closed position and thus with all fluid passing down the flow control tool to a drilling, milling or reaming bit downhole of the flow control tool. In the event that it is desired to stimulate flow along the wellbore annulus, the flow control member is moved to the first open position, to direct part of the fluid to the tool exterior and thus into the annulus. This may stimulate flow of solids such as drilling cuttings generated during the drilling operation, the solids entrained in the fluid flowing to surface. Alternatively, drilling may commence with fluid flow to annulus as described above.

By diverting part of the fluid entering the tool to the annulus in this fashion, the pressure of fluid in a tubing string carrying the tool at a location downstream of the tool is reduced, thereby reducing wear on other downhole components such as drilling motors and bits. This is achieved whilst maintaining an effective circulation of fluid to annulus to stimulate flow of solids to surface, and is of particular utility in deviated wells.

Fluid flowing to the tool exterior may be directed in an uphole direction, which may be achieved by providing the at least one first flow port inclined relative to the tool body, in particular relative to an axis of the main body bore.

Movement of the flow control member to the first open position may direct fluid through the at least one first flow port to the tool exterior, to stimulate flow of fluid to surface. The method may further comprise the step of boosting the flow of fluid to the annulus, which may be achieved by moving the flow control member to the second open position, in which fluid may be directed to the tool exterior through the at least one second flow port. The fluid flow to annulus is boosted as the flow area of the at least one second flow port is greater than said first flow area. Accordingly, the method may be a method of selectively boosting the flow of fluid to the tool exterior. The flow control member may be moved to the second open position to boost the flow of fluid to the tool exterior in order to clear solids which have accumulated in the wellbore annulus and which have not been cleared by fluid flowing to the tool exterior through said at least one first flow port.

According to a third aspect of the present invention, there is provided a downhole flow control tool comprising:

a main body having an internal bore for the passage of fluid therethrough;

at least one first fluid flow port extending through a wall of the main body for the selective flow of fluid from the body internal bore to an exterior of the tool;

at least one second fluid flow port extending through the main body wall for the selective flow of fluid from the body internal bore to the tool exterior; and a flow control member mounted for movement relative to the body main bore between: a closed position in which both the at least one first and the at least one second fluid flow ports are closed, to thereby prevent flow of fluid from the body main bore to the tool exterior through said ports; a first open position in which fluid flow from the body main bore to the tool exterior through one of the at least one first and the at least one second fluid flow ports is permitted; and a second open position in which fluid flow from the body main bore to the tool exterior through the other one of the at least one first and the at least one second fluid flow ports is permitted;

wherein the at least one first flow port is dimensioned such that fluid flowing through the at least one first flow port exits at a higher velocity than fluid exiting the at least one second flow port, for a given pressure of fluid in the main body bore.

According to a fourth aspect of the present invention, there is provided a method of controlling fluid flow downhole, the method comprising the steps of:

locating a flow control tool downhole;

directing fluid into an internal bore of a main body of the tool, the main body having at least one first fluid flow port extending through a wall of the main body and at least one second flow port extending through the main body wall, the at least one first fluid flow port dimensioned such that fluid in the body main bore at a given fluid pressure exits the at least one first fluid flow port at a higher velocity than fluid exiting the at least one second fluid flow port;

locating a flow control member of the tool in a closed position where the at least one first and the at least one second fluid flow ports are closed, so that the fluid entering the tool flows through the body internal bore and exits the tool;

selectively moving the flow control member relative to the internal bore to a first open position in which at least part of the fluid entering the tool flows through one of the at least one first and the at least one second fluid flow ports and thus to an exterior of the tool; and selectively moving the flow control member to a second open position in which at least part of the fluid entering the tool flows along the other one of the at least one first and the at least one second fluid flow ports and thus to the exterior of the tool.

BRIEF DESCRIPTION OF THE DRAWINGS

An embodiment of the present invention will now be described, by way of example only, with reference to the accompanying drawings, in which.

MODES FOR PERFORMANCE OF THE INVENTION

Figure 1:
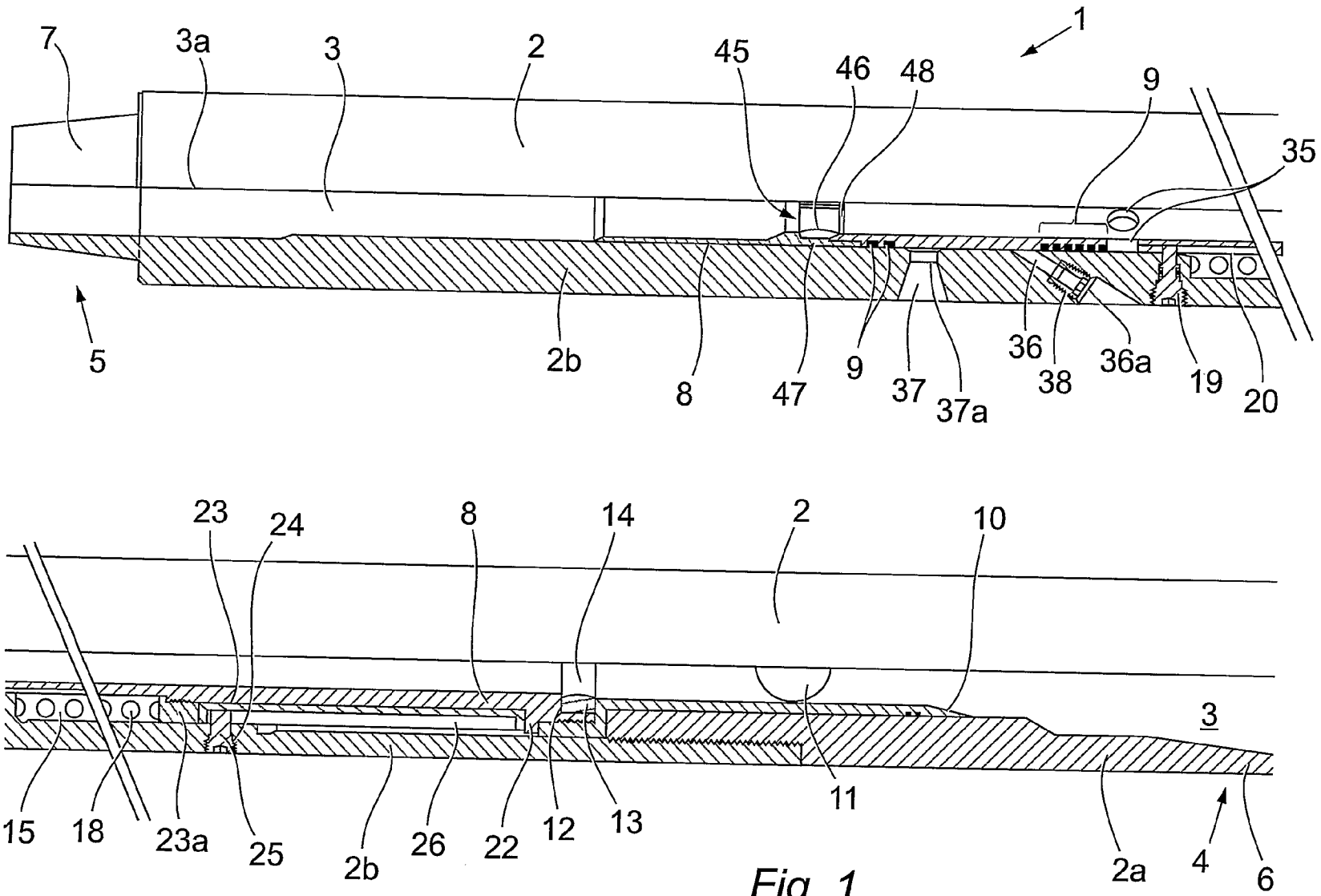
FIG. 1 is a longitudinal half-sectional view of a downhole flow control tool according to an embodiment of the present invention, a lower portion of the tool shown in the upper half of FIG. 1 and an upper portion shown in the lower half of FIG. 1, the tool shown in the Figure with a flow control member of the tool in a closed position.
Figure 2:
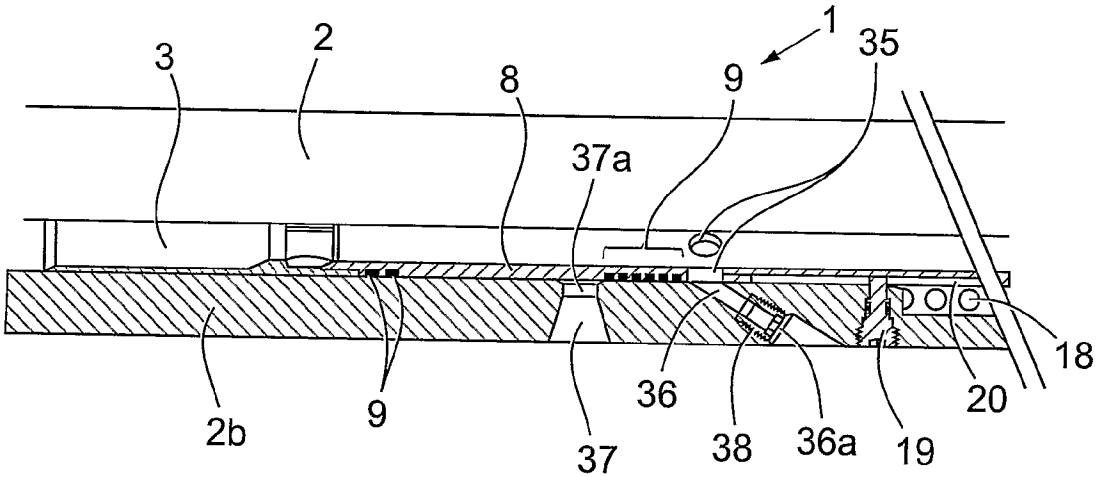
FIGS. 2 and 3 are views of part of the tool shown in FIG. 1, the tool shown in FIG. 2 with the flow control member of the tool in a first open position and in FIG. 3 with the flow control member in a second open position.
Figure 3:
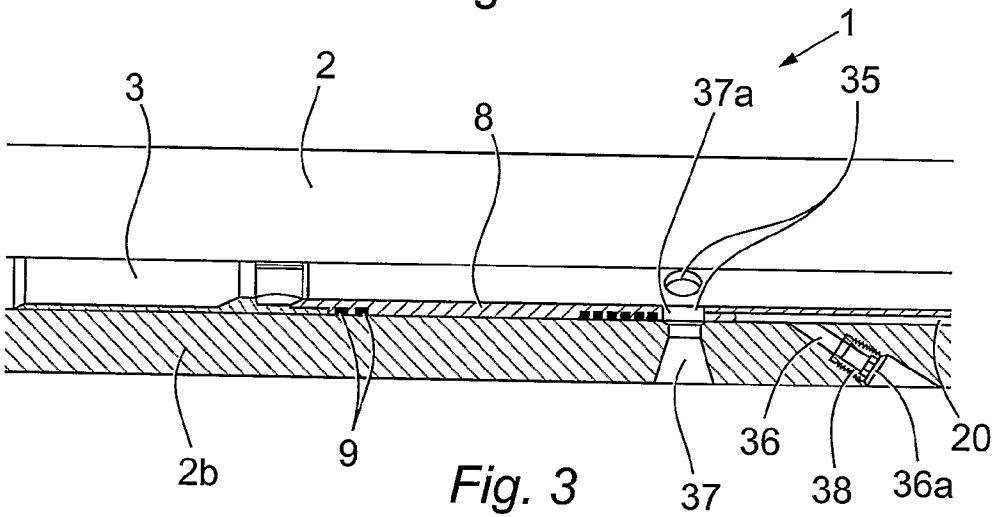

Reference is initially made to FIG. 1 of the drawings, which illustrates a downhole flow control tool, in accordance with an embodiment of the present invention, the tool indicated generally by reference numeral 1, and shown in FIG. 1 with a flow control member in the form of a sleeve 8 in a closed position. Reference is also made to FIGS. 2 and 3, in which the flow control sleeve 8 is shown in first and second open positions, respectively.

The tool 1 generally comprises a main body 2 having a longitudinal internal bore 3 extending therethrough, an upper end 4 and a lower end 5. The upper end 4 comprises a box section 6 and the lower end 5 a pin section 7, which enable connection of the tool 1 into a work string (not shown).

The flow control sleeve 8 is mounted for movement relative to the bore 3 between the closed position shown in FIG. 1, the first open position shown in FIG. 2, and the second open position shown in FIG. 3. The tool body 2 includes at least one first flow port 36 extending through a wall of the body 2 and, in the illustrated embodiment, includes a number of first flow ports 36 spaced around a circumference of the body 2. The body 2 also includes at least one second flow port 37, axially spaced along the body 2 from the first flow ports 36, and which also extends through the wall of the body 2. In the illustrated embodiment, the body 2 includes a number of second flow ports 37 spaced around a circumference of the body 2.

The first flow ports 36 each comprise an outlet 36*a* having a first flow area, and the second flow ports 37 each comprise an outlet 37*a* having a second flow area which is greater than said first flow area. In this fashion, fluid in the body bore 3 of a given fluid pressure will exit the outlets 36*a* of the first flow ports 36 at a higher velocity than through the outlets 37*a* of the second flow ports 37.

The flow control sleeve 8 controls fluid flow from the body bore 3 to an exterior of the tool, and thus to an annulus defined between the tool outer surface and an inner surface of a wellbore (not shown) in which the tool 1 is located, depending upon the position of the sleeve 8. In more detail, in the closed position of FIG. 1, the flow control sleeve 8 closes both of the first and second flow ports 36 and 37, such that all fluid entering the bore 3 at the upper end 4 of the tool flows down through the bore 3 and exits the bore at the lower end 5 of the tool. In the first open position of the flow control sleeve 8 shown in FIG. 2, the sleeve 8 opens the first flow ports 36, permitting flow of fluid from the body bore 3 to the tool exterior through the ports 36. In the first open position, the second flow ports 37 remain closed. In the second open position of the flow control sleeve 8 shown in FIG. 3, the sleeve 8 opens the second flow ports 37, permitting flow of fluid from the body bore 3 to the tool exterior through the ports 37. In the second open position, the sleeve 8 again closes the first flow ports 36.

Due to the different flow areas of the outlets 36*a* and 37*a* of the flow ports 36 and 37, fluid can be directed to the tool exterior at different velocities, for carrying out different functions downhole, as will be described in more detail below.

The tool 1 and its method of operation will now be described in more detail. The flow control sleeve 8 includes a number of O-rings 9, which form a seal between the sleeve 8 and the inner surface of the bore 3 at various locations. An upper end 10 of the sleeve 8 is tapered, to receive and assist passage of a drop ball 11 into the sleeve, and thus directs the drop ball 11, with minimal turbulence, into the sleeve 8. The sleeve 8 also includes a ball seat 12 downstream of the tapered end 10, which is located in a first sleeve recess 13. The ball seat 12 is elastically deformable and defines an aperture 14 having an inner diameter less than that of the drop ball 11. Accordingly, further passage of the drop ball 11 along the sleeve 8 is restricted by the seat 12, and the ball 11 is thus landed out on the seat, forming a seal which prevents further fluid flow through the tool bore 3.

The tool body 2 is made up from an upper body portion 2*a* and a lower body portion 2*b*, which are coupled by a threaded connection, and which define a recess or chamber 15 therebetween. A spring 18 is located within the chamber 15, and acts to bias the sleeve 8 towards the upper end 4 of the tool 1. A guide pin 19 extends through the body 2 and locates within a groove 20 in an external surface of the sleeve 8, to restrict the sleeve 8 against rotation within and thus relative to the bore 3.

Figure 4:
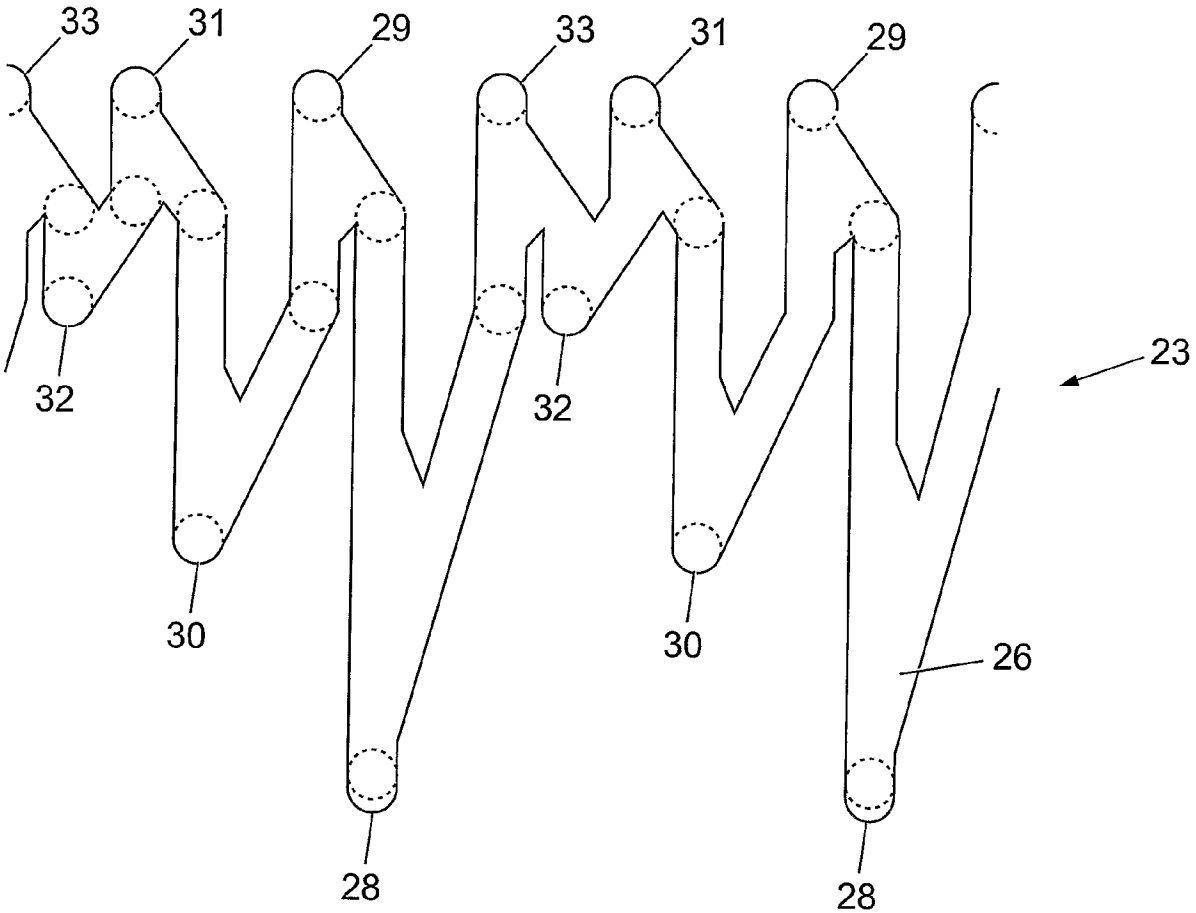
FIG. 4 is an opened-out view of an indexing channel of an indexing sleeve of the tool shown in FIG. 1.

The flow control sleeve 8 includes a shoulder 22, and an index sleeve 23 is located on an outer surface of the flow control sleeve 8 in abutment with the shoulder 22. The index sleeve 23 is secured against axial movement relative to the flow control sleeve by a threaded annular retaining member 23*a*. The body 2 also includes a locating hole 24, and an index pin 25 is located in the hole 24, extending into a profiled indexing channel or groove 26 of the index sleeve 23. As shown in FIG. 4, which is an opened-out view of the indexing channel 26, the channel extends around an external circumference of the indexing sleeve 23 and, through engagement of an indexing pin 25 within the groove 26, controls axial movement of the flow control sleeve 8 relative to the body 2 and thus within the bore 3.

To achieve control of movement of the flow control sleeve 8, the indexing channel 26 includes a number of detent positions for the indexing pin 25, as best shown in FIG. 4. In more detail, the indexing channel 26 defines first, second and third detent positions 28, 30 and 32, respectively. Also, a number of intermediate detent positions 29, 31 and 33 are defined between the first and second detent positions 28 and 30; the second and third detent positions 30 and 32; and the third and first detent positions 32 and 28, respectively.

The spring 18 biases the sleeve 8 uphole, and thus urges the indexing sleeve 23 to a position where the indexing pin is located in one of the first, second or third detent positions 28, 30 or 32. Initially, the tool 1 is configured such that the indexing pin 25 is in the first detent position 28. When the index pin is in the first detent position 28, the flow control sleeve 8 is in the closed position shown in FIG. 1, and thus the first and second flow ports 36 and 37 are closed. As will be described in more detail below, the tool 1 is made up to a tool string (not shown), such as a drill string for drilling a wellbore, with the tool in this configuration and thus with the flow ports 36 and 37 closed.

The flow control sleeve 8 also includes five sleeve ports 35 (two shown), which are spaced around a circumference of the sleeve 8 and arranged perpendicularly to the body bore 3. These sleeve ports 35 permit fluid flow from the body bore 3 to the tool exterior through either the first or second body flow ports 36 or 37, depending upon the axial position of the sleeve 8 within the body bore 3. The first body ports 36 comprise a nozzle assembly 38 defining the outlet 36*a*, and which provide a jet of fluid to the tool exterior when the sleeve ports 35 are in alignment with the ports 36. The first body ports 36 are also inclined relative to a main axis 3*a* of the tool 1, and are angled uphole and thus directed towards the upper end 4 of the tool. In this fashion, upon actuation of the tool 1, fluid can be jetted in an uphole direction through each of the first flow ports 36. In contrast, each of the second body ports 37 is located perpendicularly to the bore 3, to produce radial jets of fluid upon actuation of the tool 1.

FIGS. 5*a* through 5*f* illustrate movement of the indexing sleeve, in use, and the position of the indexing pin 25 within the indexing channel 26. Each of the intermediate detent positions 29, 31 and 33 are axial aligned at topmost apexes of the profiled groove 26. The first, second and third detent positions 28, 30 and 32 are axially staggered along a length of the indexing sleeve 23. The index pin 25 may thus be located at one of four distinct locations spaced along a length of the indexing sleeve 23, depending upon the axial position of the indexing sleeve 23, and thus of the flow control sleeve 8, within the body bore 3. The portions of the indexing channel 26 are inclined relative to the tool main axis 3*a*, to encourage the index pin 25 to located in an adjacent detent position upon axial reciprocation of the index sleeve 23, as will now be described.

Figure 5A:
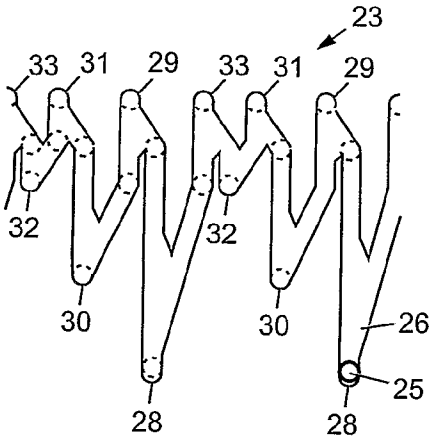
FIGS. 5*a* to 5*f* are views illustrating the interaction between an index pin of the tool of FIG. 1 with the indexing channel of FIG. 4, in use.
Figure 5B:
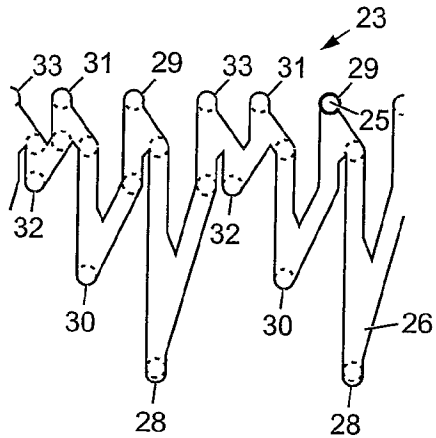

The indexing sleeve 23 is axially reciprocated by landing a first drop ball 11 on the ball seat 12, causing an increase in fluid pressure acting on the ball 11. This generates a fluid pressure force on the flow control sleeve 8 and, when this fluid pressure force is sufficiently high, the sleeve 8 is urged downwards against the biasing force of the spring 18. During this movement of the flow control sleeve 8, the indexing sleeve 23 is also carried axially downwardly, and the indexing pin then moves from the first detent position 28 to locate in the first intermediate detent position 29. This movement is illustrated in FIGS. 5*a* and 5*b*. In this position of the flow control sleeve 8, the sleeve ports 35 are located below (downstream) of both the first and second body flow ports 36 and 37, such that flow to annulus is still closed.

Figure 5C:
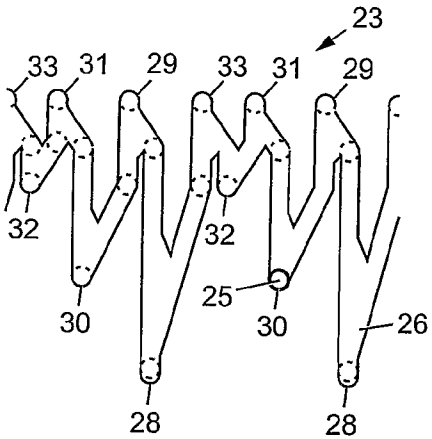

The fluid pressure force continues to act upon the flow control sleeve 8, holding the indexing pin 25 in the first intermediate detent position 29, until such time as the fluid pressure acting on the ball 11 has been raised to a level sufficient for the ball to deform the ball seat 12. The ball 11 is then blown through the ball seat and passes on down the body bore 3 out of the tool 1, and is collected by a ball catcher or the like further down the tool string. When the ball 11 is blown through, the fluid pressure force acting upon the flow control sleeve 8 reduces, and the biasing spring then urges the flow control sleeve 8 in an uphole direction, locating the index pin 25 in the second detent position 30, as shown in FIG. 5*c*. In this position of the indexing sleeve 23, and thus of the flow control sleeve 8, the sleeve ports 35 are aligned with the first body flow ports 36. Accordingly, part of the fluid flowing down into the tool 1 is now directed through the inclined first flow ports 36, and is jetted in an uphole direction. This is of particular utility where the tool 1 is incorporated into a drill string, as the upwardly directed fluid assists in the passage of fluid carrying entrained drill cuttings to surface along the wellbore annulus. Additionally, this splitting of the fluid flow provides a reduction in the pressure of the fluid flowing on down the body bore 3 to downstream tools or components, such as a drilling motor or drill bit. Thus an effective flow along the annulus is achieved whilst reducing wear on such further downhole components.

Figure 5D:
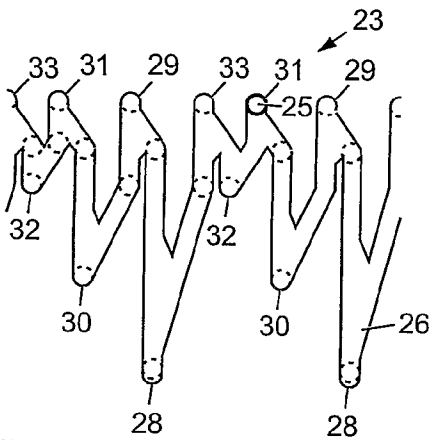
Figure 5E:
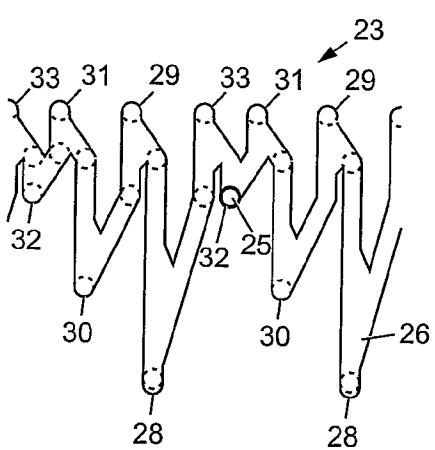

Jetting through the first radial body ports 36 continues until such time as an operator of the tool wishes to provide a boosted flow of fluid to annulus. This may be desired, for example, in situations where there has been a build-up of solids in the wellbore annulus, which can be a particular problem in highly deviated wells. The tool 1 is first located in a problem area, adjacent a solids deposit, and the tool then actuated to open the second body ports 37. This is achieved by dropping a second drop ball, alike to the first ball 11, into the work string. In a similar fashion to that described above, the second ball lands out on the ball seat 12, and pressure behind the ball urges the flow control sleeve 8 down against the force of the spring 18, bringing the indexing pin 25 into the second intermediate position 31, as shown in FIG. 5*d*. When the second drop ball is blown through the ball seat 12, the flow control sleeve 8 is again urged upwardly by the biasing spring 18, locating the indexing pin 25 in the third detent position 32, as shown in FIG. 5*e*. In the third detent position 32, the sleeve ports 35 are aligned with the second body flow ports 37, and part of the fluid flowing down into the tool 1 flows to annulus through the second body ports 37. In fact, the flow area of the second body port outlets 37*a*, and the relative hydrostatic pressure further down the tool string, is such that a majority of the fluid entering the tool 1 is directed out through the second body ports 37. This provides a significant 'boosted' flow of fluid to annulus to clear any solid deposits.

Figure 5F:
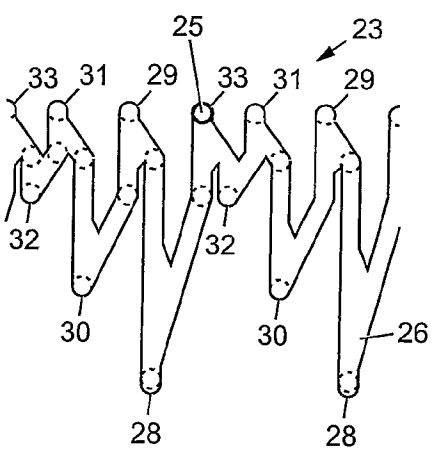

Once the deposits have been cleared and it is desired to resume normal operations, the tool is returned to the configuration where the flow ports 36 and 37 are closed. This is achieved by dropping a third drop ball, alike to the ball 11, down the work string. The third drop ball lands on the ball seat 12, and build up of fluid pressure behind the ball again forces the flow control sleeve 8 downwards. The indexing pin 25 is then located in the third intermediate position, as shown in FIG. 5*f*. When the third drop ball is forced through the ball seat 12, the spring 18 urges the flow control sleeve 8 back up, the index pin 25 then locating in the next detent position, which is equivalent to the first detent position 28. The flow control sleeve is thus now once again in the closed position of FIG. 1, where all fluid entering the tool 1 flows down through the body bore 3 and exits the tool. When it is desired either to provide jets of fluid to encourage flow along the wellbore annulus, or to provide boosted flow to annulus, the flow control sleeve 8 can once again be cycled through the closed, first open and second open positions described above, by repeating the process described herein.

The tool 1, according to an aspect of the invention, also includes a ball non-return mechanism 45 provided within the sleeve 8 between the sleeve ports 35 and a lower end of the sleeve. The mechanism 45 is provided to ensure that a drop ball 11 cannot flow back in an uphole direction along the body bore 3. The mechanism 45 includes a split ring 46 located in a sleeve recess 47, and the split ring 46 has an outer diameter greater than the inner diameter of the sleeve 8, defining a restriction to passage of drop balls 11. However, in the position shown in FIG. 1, the split ring 46 describes a throughbore of larger diameter than the ball seat 12. Accordingly, drop balls passing down through the body bore, following release from the ball seat 12, easily blow through the split ring 46.

The flow control sleeve 8 is shaped to define a tapered section 48 adjacent the recess 47, and which cooperates with the split ring 46. In the event that a drop ball 11 enters the lower end of the flow control sleeve 8, travelling in an uphole direction, the ball comes into contact with the split ring 46. Further passage of the drop ball uphole carries the split ring 46 up the tapered section 48. This movement of the split ring 46 causes the ring to define a progressively increasing restriction to passage of the drop ball, ultimately preventing the drop ball 11 from passing further uphole.

Industrial Application

The tool 1 has a general utility downhole in situations where it is desired to provide a selective flow of fluid to annulus, and thus to split the flow of fluid passing down through a tool string. However, the tool 1 has a particular utility in the drilling of a wellbore, as referred to above.

In general terms, a wellbore would be drilled using a drill string (not shown) incorporating the tool 1 and having a drillbit at a lower end of the string for penetrating subterranean rock formations. A fluid driven drilling motor may also be incorporated into the drill string at a location between the drill bit and the flow control tool 1, although it will be understood by persons skilled in the art that the string may alternatively be rotated from surface using a top-drive (not shown).

The tool 1 is made-up to the drill string with the flow control sleeve 8 initially in the closed position shown in FIG. 1. Drilling then progresses with drilling fluid passing down through the string and along the tool bore 3, exiting the tool 1 and flowing on to the drillbit. The fluid then exits the bit and flows along the annulus back to surface, carrying drill cuttings. If, during the drilling process, it is desired to stimulate flow of fluid along the annulus at a location along a length of the string and without subjecting the drill bit and/or motor to excessively high fluid pressures, the flow control tool 1 is actuated as described above, to open the first, jetting flow ports 36. This splits the flow of fluid and provides jets to annulus directed uphole, assisting in the passage of fluid along the annulus and helping maintain entrained cuttings in suspension.

In the event that, for example, cuttings settle out and start to block the annulus, a situation which would be detected at surface by an increase in pressure, drilling would be halted. The flow control tool 1 would then be located adjacent the area where the cuttings are anticipated to have settled out, and the tool 1 actuated as described above to open the second, boosting ports 37. This provides a significant flow to annulus to clear the blockage and carry the cuttings to surface.

Drilling may then recommence by actuating the tool to move the flow control sleeve 8 back to the closed position, with all fluid flow down through the tool 1 to the motor/drillbit.

Various modifications may be made to forgoing without departing from the spirit and scope of the present invention.

For example, it will also be appreciated that although, for the purposes of convenient illustration, the terms up and down have been used or otherwise implied, the tool could equally be employed in any direction including the inverse direction or, for example, in a horizontal or inclined bore. It can also be conceived that the tool could be operated in a reverse circulation procedure.

The at least one first fluid flow port may be arranged such that the port axis does not intersect with said body bore axis, to stimulate a helical flow of fluid in a wellbore in which the tool is located.

The at least one first and at least one second fluid flow ports may be spaced circumferentially relative to one another. The flow control member may then be correspondingly rotationally movable relative to the body bore, for controlling flow through the selected one of the at least one first and at least one second fluid flow ports.

The tool, according to another aspect of the invention, may comprise at least one third fluid flow port extending through a wall of the main body for the selective flow of fluid from the body internal bore to an exterior of the tool, the at least one third fluid flow port comprising an outlet having a third fluid flow area which may be greater than said second flow area, or smaller than said first flow area. The flow control member may then be movable to a third open position in which fluid flow form the main body bore to the tool exterior through the at least one third fluid flow port is permitted. The at least one third flow port may be axially and/or circumferentially spaced along the body main bore relative to both the at least one first and at least one second flow ports.

Where the tool comprises at least one third fluid flow port, the indexing channel may comprise a fourth detent position corresponding to the third position of the flow control member.

Drilling (or other downhole procedures) may commence with fluid flow to annulus through one of the at least one first or at least one second body flow ports.

The invention claimed is:

1. A downhole flow control tool comprising:

a main body having an internal bore for the passage of fluid therethrough;

at least one first fluid flow port extending through a wall of the main body for the selective flow of fluid from the body internal bore to an exterior of the tool, the at least one first fluid flow port comprising an outlet having a first fluid flow area;

at least one second fluid flow port extending through the main body wall for the selective flow of fluid from the body internal bore to the tool exterior, the at least one second fluid flow port comprising an outlet having a second fluid flow area greater than said first fluid flow area; and a flow control member mounted for movement relative to the body main bore between: a closed position in which both the at least one first and the at least one second fluid flow ports are closed, to thereby prevent flow of fluid from the body main bore to the tool exterior through said ports; a first open position in which fluid flow from the body main bore to the tool exterior through one of the at least one first and the at least one second fluid flow ports is permitted; and a second open position in which fluid flow from the body main bore to the tool exterior through the other one of the at least one first and the at least one second fluid flow ports is permitted.

2. The tool claimed in claim 1, wherein the at least one first fluid flow port is inclined relative to the tool main body.

3. The tool claimed in claim 2, wherein the at least one first fluid flow port is inclined relative to an axis of the body internal bore.

4. The tool claimed in claim 3, wherein the at least one first fluid flow port is arranged such that an axis of the port intersects with the body bore axis.

5. The tool claimed in claim 3, wherein the at least one first fluid flow port is arranged such that an axis of the port does not intersect with the body bore axis, to stimulate a helical flow of fluid.

6. The tool claimed in claim 1, wherein in the first open position of the flow control member, the at least one second flow port is closed and flow is directed through the at least one first flow port.

7. The tool claimed in claim 6, wherein in the second open position of the flow control member, the at least one first flow port is closed and flow directed through the at least one second flow port.

8. The tool claimed in claim 1, wherein the at least one first and the at least one second fluid flow ports are spaced relative to one another.

9. The tool claimed in claim 8, wherein the at least one first and the at least one second fluid flow ports are axially spaced along the body main bore.

10. The tool claimed in claim 1, wherein the flow control member is movable axially relative to the body main bore for controlling flow of fluid through the selected one of the at least one first and at least one second fluid flow ports.

11. The tool claimed in claim 8, wherein the at least one first and the at least one second fluid flow ports are spaced circumferentially relative to one another.

12. The tool claimed in claim 11, wherein the flow control member is rotationally movable relative to the body bore, for controlling flow through the selected one of the at least one first and at least one second fluid flow ports.

13. The tool claimed in claim 1, further comprising at least one third fluid flow port extending through a wall of the main body for the selective flow of fluid from the body internal bore to an exterior of the tool, the at least one third fluid flow port comprising an outlet having a third fluid flow area.

14. The tool claimed in claim 13, wherein the third flow area is greater than said second flow area.

15. The tool claimed in claim 13, wherein the third flow area is smaller than said first flow area.

16. The tool claimed in claim 1, further comprising a plurality of first fluid flow ports and a plurality of second fluid flow ports, the first and second fluid flow ports being arranged around a circumference of the main body.

17. The tool claimed in claim 1, wherein the flow control member is repeatedly movable and adapted to be cycled between the closed position, the first open position and the second open position.

18. The tool claimed in claim 1, wherein the flow control member comprises an indexing sleeve having an indexing channel adapted to cooperate with an indexing pin coupled to the main body, for controlling movement of the flow control member, and thus location of the flow control member in a selected one of the closed, the first open and the second open positions.

19. The tool claimed in claim 1, wherein the flow control member comprises a flow control sleeve mounted for movement within the body bore, the flow control sleeve comprising an at least one sleeve port for selectively permitting fluid communication between the body internal bore and a selected one of the at least one first and at least one second fluid flow ports.

20. The tool claimed in claim 19, wherein the at least one sleeve port defines a flow area which is at least equal to the second flow area of the second body fluid flow port.

21. The tool claimed in claim 18, wherein the indexing sleeve is mounted on the flow control sleeve for controlling movement thereof.

22. The tool claimed in claim 21, wherein the indexing sleeve comprises an indexing channel extending around a circumference thereof, which channel comprises a first detent position corresponding to the closed position of the flow control member; a second detent position corresponding to the first open position of the flow control member; and a third detent position corresponding to the second open position of the flow control member.

23. The tool claimed in claim 1, wherein the flow control member is movable under applied fluid pressure, and comprises a seat for receiving an actuating element to move the flow control member between the closed, first open and second open positions.

24. A method of controlling fluid flow downhole, the method comprising the steps of:

locating a flow control tool downhole;

directing fluid into an internal bore of a main body of the tool, the main body having at least one first fluid flow port extending through a wall of the main body and comprising an outlet having a first fluid flow area and at least one second fluid flow port extending through the main body wall and comprising an outlet having a second fluid flow area greater than said first fluid flow area;

locating a flow control member of the tool in a closed position where the at least one first and the at least one second fluid flow ports are closed, so that the fluid entering the tool flows through the body internal bore and exits the tool;

selectively moving the flow control member relative to the internal bore to a first open position in which at least part of the fluid entering the tool flows through one of the at least one first and the at least one second fluid flow ports and thus to an exterior of the tool; and selectively moving the flow control member to a second open position in which at least part of the fluid entering the tool flows along the other one of the at least one first and the at least one second fluid flow ports and thus to the exterior of the tool.

25. The method claimed in claim 24, wherein the method is a method of controlling fluid flow downhole during a wellbore drilling operation.

26. The method claimed in claim 25, wherein the method is a method of selectively directing fluid into an annulus defined between a wellbore wall and the exterior of a tubing string carrying the tool, to stimulate flow of fluid to surface.

27. The method claimed in claim 25, wherein drilling initially proceeds with the flow control member in a closed position and thus with all fluid passing down the flow control tool to a drillbit downhole of the flow control tool.

28. The method claimed in claim 27, wherein the flow control member is subsequently moved to the first open position, to direct part of the fluid to the tool exterior and thus into the annulus to stimulate flow of fluid to surface.

29. The method claimed in claim 25, wherein drilling initially proceeds with the flow control member in the first open position and thus with part of the fluid directed to the tool exterior to stimulate flow of fluid to surface.

30. The method claimed in claim 24, wherein fluid flowing to the tool exterior is directed in an uphole direction by providing the at least one first flow port inclined relative to the tool body.

31. The method claimed in claim 26, wherein the method further comprises the step of boosting the flow of fluid to the annulus by moving the flow control member to the second open position, in which fluid is directed to the tool exterior through the at least one second flow port.

32. The method claimed in claim 31, wherein the method is a method of selectively boosting the flow of fluid to the tool exterior.

33. The method claimed in claim 32, wherein the flow control member is moved to the second open position to boost the flow of fluid to the tool exterior in order to clear solids which have accumulated in the wellbore annulus.

34. A downhole flow control tool comprising:

a main body having an internal bore for the passage of fluid therethrough;

at least one first fluid flow port extending through a wall of the main body for the selective flow of fluid from the body internal bore to an exterior of the tool;

at least one second fluid flow port extending through the main body wall for the selective flow of fluid from the body internal bore to the tool exterior; and a flow control member mounted for movement relative to the body main bore between: a closed position in which both the at least one first and the at least one second fluid flow ports are closed, to thereby prevent flow of fluid from the body main bore to the tool exterior through said ports; a first open position in which fluid flow from the body main bore to the tool exterior through one of the at least one first and the at least one second fluid flow ports is permitted; and a second open position in which fluid flow from the body main bore to the tool exterior through the other one of the at least one first and the at least one second fluid flow ports is permitted;

wherein the at least one first flow port is dimensioned such that fluid flowing through the at least one first flow port exits at a higher velocity than fluid exiting the at least one second flow port, for a given pressure of fluid in the main body bore.

* * * * *